US011441841B2

(12) United States Patent
Kurtz

(10) Patent No.: US 11,441,841 B2
(45) Date of Patent: Sep. 13, 2022

(54) HEAT EXCHANGER ASSEMBLY AND METHOD FOR ASSEMBLING SAME

(71) Applicant: L'Air Liquide, Societe Anonyme pour l'Etude et l'Exploitation des Procedes Georges Claude, Paris (FR)

(72) Inventor: Remy Kurtz, Cracow (PL)

(73) Assignee: L'Air Liquide, Societe Anonyme Pour L'Etude Et L'Exploitation des Procedes Georges Claude, Paris (FR)

( * ) Notice: Subject to any disclaimer, the term of this patent is extended or adjusted under 35 U.S.C. 154(b) by 121 days.

(21) Appl. No.: 16/724,190

(22) Filed: Dec. 21, 2019

(65) Prior Publication Data

US 2020/0208912 A1 Jul. 2, 2020

(30) Foreign Application Priority Data

Dec. 28, 2018 (CN) ..... 201811626459.7

(51) Int. Cl.

| | |
|---|---|
| ***F25J 3/04*** | (2006.01) |
| ***F28F 9/00*** | (2006.01) |
| ***F28F 9/26*** | (2006.01) |

(52) U.S. Cl.

CPC ..... *F25J 3/04963* (2013.01); *F25J 3/0489* (2013.01); *F25J 3/04945* (2013.01);

(Continued)

(58) Field of Classification Search

CPC .... F25J 3/0489; F25J 3/04945; F25J 3/04963; F25J 3/04975; F25J 1/0259; F25J 2290/42

See application file for complete search history.

(56) References Cited

U.S. PATENT DOCUMENTS 3,302,417 A * 2/1967 Cowans ..... F25J 1/0276 62/49.2
3,754,406 A * 8/1973 Allam ..... F25J 3/04303 62/646

(Continued)

FOREIGN PATENT DOCUMENTS

CN 11 99 458 11/1998
CN 103 375 968 10/2013

(Continued)

OTHER PUBLICATIONS

EP Search Report and Written Opinion for EP 19217852, dated Apr. 17, 2020.

*Primary Examiner* — Jianying C Atkisson
*Assistant Examiner* — Jose O Glass-Quinones
(74) *Attorney, Agent, or Firm* — Justin K. Murray

(57) ABSTRACT

A heat exchanger assembly and a method for assembling the heat exchanger assembly is provided. The heat exchanger assembly comprises a first heat exchanger and a second heat exchanger, and a subcooler; a first heat exchanger cold box, for accommodating the first heat exchanger and heat exchange fluid pipelines, with a first opening being disposed in a side of the first heat exchanger cold box, and a first group of pipelines extending through the first opening; a second heat exchanger cold box, for accommodating the second heat exchanger and heat exchange fluid pipelines, with a second opening being disposed in a side of the second heat exchanger cold box, and a second group of pipelines extending through the second opening; a subcooler cold box, for accommodating the subcooler and heat exchange fluid pipelines, with a third opening and a fourth opening being disposed in a side of the subcooler cold box, and a third group of pipelines and a fourth group of pipelines extending through the third opening and the fourth opening respectively, wherein the first group of pipelines and the third (Continued)

group of pipelines are connected and encapsulated in a first thermally isolating casing, and the second group of pipelines and the fourth group of pipelines are connected and encapsulated in a second thermally isolating casing.

13 Claims, 2 Drawing Sheets

(52) U.S. Cl.
CPC ..... *F28F 9/005* (2013.01); *F28F 9/26* (2013.01); *F28F 2230/00* (2013.01); *F28F 2270/00* (2013.01); *F28F 2275/06* (2013.01)

(56) References Cited

U.S. PATENT DOCUMENTS 3,919,852 A * 11/1975 Jones ..... F25J 1/0037 62/7
4,560,398 A * 12/1985 Beddome ..... F25J 3/0409 62/646
4,790,866 A * 12/1988 Rathbone ..... F25J 3/0409 62/651
4,860,421 A 8/1989 Breda et al.
5,349,827 A * 9/1994 Bracque ..... F25J 3/0489 29/429
5,355,682 A * 10/1994 Agrawal ..... F25J 3/0409 62/646
5,412,954 A * 5/1995 Grenier ..... F17C 13/001 62/646
5,461,871 A * 10/1995 Bracque ..... F25J 3/04872 62/643
5,896,755 A * 4/1999 Wong ..... F25J 3/04678 62/643
5,916,260 A * 6/1999 Dubar ..... F25J 1/005 62/613
5,934,105 A * 8/1999 Bonaquist ..... F25J 3/04303 62/646
6,128,921 A * 10/2000 Guillard ..... F25J 3/04945 62/643
6,148,637 A * 11/2000 Guillard ..... F25J 3/04466 62/643
6,250,244 B1 * 6/2001 Dubar ..... F25J 1/0022 114/264
6,910,350 B2 * 6/2005 Brigham ..... F25J 3/04254 202/83
6,948,337 B2 * 9/2005 Moeller ..... F25J 3/04412 62/643
7,516,626 B2 * 4/2009 Brox ..... F25J 3/04951 62/643
7,621,152 B2 * 11/2009 Howard ..... F25J 3/0409 62/620
7,954,339 B2 * 6/2011 Gibbon ..... F25J 3/0489 62/643
8,021,464 B2 * 9/2011 Gauthier ..... C01B 3/506 95/96
9,170,048 B2 * 10/2015 Lochner ..... F25J 3/04187
9,228,778 B2 * 1/2016 Rampp ..... F25J 3/04872
9,816,765 B2 * 11/2017 Rampp ..... F25J 3/04018
10,920,935 B2 * 2/2021 Cavagne ..... F25J 3/04945
2002/0062658 A1 * 5/2002 Schoenecker ..... F25J 3/04224 62/650
2003/0089126 A1 * 5/2003 Stringer ..... F25J 3/04412 62/643
2004/0035149 A1 * 2/2004 Moeller ..... F25J 3/0489 62/643
2011/0031861 A1 * 2/2011 Gentry ..... F25J 1/0261 312/406
2013/0118204 A1 * 5/2013 Higginbotham ..... F25J 1/0012 62/615
2015/0096327 A1 4/2015 Lochner et al.
2016/0298900 A1 * 10/2016 Davidian ..... F25J 3/04963
2018/0209727 A1 * 7/2018 Saboda ..... F25J 3/04878

FOREIGN PATENT DOCUMENTS

CN 104 110 998 10/2014
CN 104 457 332 3/2015
EP 0 859 209 8/1998
WO 2013/102715 7/2013

* cited by examiner

HEAT EXCHANGER ASSEMBLY AND METHOD FOR ASSEMBLING SAME

CROSS REFERENCE TO RELATED APPLICATIONS

This application claims the benefit of priority under 35 U.S.C. § 119 (a) and (b) to Chinese patent application No. CN201811626459.7, filed Dec. 28, 2018, the entire contents of which are incorporated herein by reference.

FIELD OF THE INVENTION

The present invention relates to a heat exchanger assembly and a method for assembling the heat exchanger assembly, in particular to a method, which facilitates the on-site connection of heat exchanger cold boxes.

BACKGROUND OF THE INVENTION

Air separation requires air to be cooled to a very low temperature. In order to prevent heat exchange with the outside and reduce cold loss, cryogenic containers such as cryogenic heat exchangers and distillation columns are always placed in a cold box, which is packed with a thermally isolating material with low thermal conductivity.

In US2015/0096327, by means of a specific conduit box, prefabrication thereof separately from a column cold box is achieved, and some conduits and valves which were originally in the column cold box are disposed in the conduit box; in this way, the dimensions of the column cold box can be reduced. The conduit box comprises multiple fluid pipelines, control lines and air lines used for all the meters; electric cables etc. may also be connected in a factory. The conduit box is transported to an installation site, hoisted using a crane, then connected to the column cold box via conduit connection ends, realizing the interconnection of fluid pipelines, meter air pipelines, control lines and electric cables. In this situation, due to the complex interconnection of conduit connection ends between the conduit box and the other cold box, and the need to use a crane for on-site hoisting of the conduit box, the on-site workload associated with connecting the conduit connection ends and crane hoisting is also correspondingly increased.

SUMMARY OF THE INVENTION

In order to solve the abovementioned technical problem, a heat exchanger assembly and a method for assembling the heat exchanger assembly are disclosed in the present invention. Through the assembly and method, the connection of pipelines between a high-pressure heat exchanger cold box, a low-pressure heat exchanger cold box and a subcooler cold box can be completed at the site; due to the fact that the number of pipelines needing to be connected at the site is limited, and the fact that it is only necessary to assemble a thermally isolating casing around connection components and pack this with a thermally isolating material, it is possible to use a simple tool such as a forklift truck instead of a crane to perform the work of connecting the pipelines and hoisting the thermally isolating casings, so the on-site workload is greatly reduced.

The abovementioned object is achieved principally in the following manner:

Disclosed in the present invention is a heat exchanger assembly, comprising a first heat exchanger and a second heat exchanger, and a subcooler; a first heat exchanger cold box, for accommodating the first heat exchanger and heat exchange fluid pipelines, with a first opening being disposed in a side of the first heat exchanger cold box, and a first group of pipelines extending through the first opening; a second heat exchanger cold box, for accommodating the second heat exchanger and heat exchange fluid pipelines, with a second opening being disposed in a side of the second heat exchanger cold box, and a second group of pipelines extending through the second opening; a subcooler cold box, for accommodating the subcooler and heat exchange fluid pipelines, with a third opening and a fourth opening being disposed in a side of the subcooler cold box, and a third group of pipelines and a fourth group of pipelines extending through the third opening and the fourth opening respectively, wherein: the first group of pipelines and the third group of pipelines are connected and encapsulated in a first thermally isolating casing, and the second group of pipelines and the fourth group of pipelines are connected and encapsulated in a second thermally isolating casing.

Preferably, the first heat exchanger cold box, the second heat exchanger cold box and the subcooler cold box are all installed on the ground.

Preferably, the first heat exchanger and the second heat exchanger form a main heat exchanger in cryogenic air separation equipment.

Preferably, the first group and third group of pipelines, and the second group and fourth group of pipelines, are connected by means of connection components.

Preferably, the connection components comprise a pipeline and/or a flange.

Preferably, a thermally isolating material is packed into the thermally isolating casing.

Preferably, the third opening and the fourth opening are on two oppositely disposed sides of the subcooler cold box.

Preferably, the third opening and the fourth opening are on the same side of the subcooler cold box.

Preferably, the third opening and the fourth opening are on two adjacently disposed sides of the subcooler cold box.

Also disclosed in the present invention is a method for assembling the heat exchanger assembly, comprising the following steps: manufacturing the first heat exchanger cold box, the second heat exchanger cold box and the subcooler cold box in a workshop, and transporting same to a site, wherein: the first group of pipelines and the third group of pipelines are connected at the site, a first sealing panel and a third sealing panel are installed on the first opening and the third opening, and the pipelines and connection components are encapsulated in the first thermally isolating casing by installing a casing outside the pipelines and connection components and packing with a thermally isolating material; the second group of pipelines and the fourth group of pipelines are connected, a second sealing panel and a fourth sealing panel are installed on the second opening and the fourth opening, and the pipelines and connection components are encapsulated in the second thermally isolating casing by installing a casing outside the pipelines and connection components and packing with a thermally isolating material.

Preferably, the thermally isolating casings are connected to the sealing panels by welding.

The present invention has the following beneficial effects relative to the prior art:

1. Compared with the conduit box solution, the number of pipelines which need to be connected at the site in the present invention is much smaller than the number of conduit connection ends, such that the work involved in connecting pipelines between the main heat exchanger cold boxes and the subcooler cold box is much simpler.

2. In the present invention, a forklift truck is all that is needed to perform the work of connecting pipelines and hoisting the thermally isolating casings; thus the cost of using a crane is saved, the on-site workload is reduced, and the complexity of hoisting at the site is also reduced.

3. In the present invention, the cold boxes can be arranged rationally according to site conditions at the site, such that the site utilization rate is maximized.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

Figure 1:
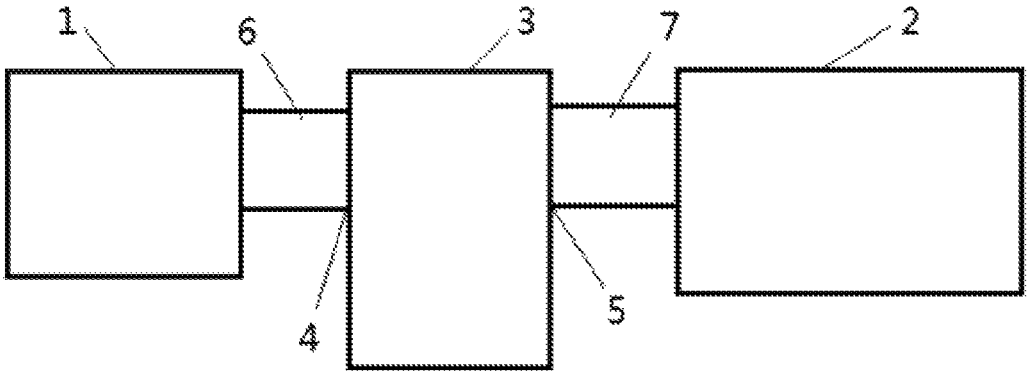
FIG. 1 shows an embodiment of assembly of the heat exchanger assembly in the present invention.

Preferred embodiments of the present invention are described further below with reference to FIGS. 1-3, which are in general schematic and, for the sake of clarity, not drawn to scale.

DETAILED DESCRIPTION OF THE INVENTION

A main heat exchanger is used to cool feed air for cryogenic air separation by performing indirect heat exchange with return fluid from a distillation column system. The distillation column system comprises a two-column system for oxygen/nitrogen separation, the two-column system having a high-pressure column and a low-pressure column, with a main condenser-evaporator between the high-pressure column and the low-pressure column, the function thereof being to cause gas from the column top of the high-pressure column to be liquefied by column-bottom liquid of the low-pressure column, with the column-bottom liquid of the low-pressure column being evaporated. The two columns having different operating pressures not only produce gaseous products containing oxygen and nitrogen, but also produce liquid products. These liquids may be drawn out of the air separation equipment as final liquid products, or be internally compressed (pressurized in a pump to a high pressure and reheated in the main heat exchanger), and can thereby be used as gaseous pressure products. Besides the two columns used for the separation of nitrogen and oxygen, the distillation column system may also have other equipment, for example for obtaining other air components, e.g. argon acquisition equipment or krypton/xenon acquisition equipment, wherein the argon acquisition equipment comprises at least one crude argon column. As stated above, the feed air for cryogenic air separation comprises a main feed air stream, which has been compressed in a main air compressor to higher than the operating pressure of the distillation column system and then precooled and purified; a pressurized feed air stream wherein a portion of the main feed air stream has been further compressed in an air pressurizer to a higher pressure; and a high-pressure feed air stream resulting from a portion of the pressurized feed air stream being further compressed in a pressurization end coupled to air expansion. The return fluid from the distillation column system, which return fluid is used to cool these air feeds, comprises a low-pressure nitrogen product and waste nitrogen gas drawn out from the top of the low-pressure column; medium-pressure liquid nitrogen resulting from the pressurization, in a liquid nitrogen pump, of a liquid nitrogen product drawn out from the top of the high-pressure column; and high-pressure liquid oxygen resulting from the pressurization, in a liquid oxygen pump, of a liquid oxygen product drawn out from the main condenser-evaporator of the distillation column.

The heat exchanger assembly in the present invention comprises a main heat exchanger system, the main heat exchanger system being formed of a first heat exchanger and a second heat exchanger, the first heat exchanger and second heat exchanger being used for processing fluids which are at a high pressure and a low pressure respectively; design pressures of the heat exchangers are defined according to the highest value amongst the pressures of all fluids passing through the heat exchangers. With regard to the high-pressure heat exchanger, the pressure of the high-pressure liquid oxygen resulting from the pressurization, in the liquid oxygen pump, of the liquid oxygen product drawn out from the main condenser-evaporator of the distillation column may reach 30-50 kg, which is higher than the pressures of all other fluids entering the high-pressure heat exchanger to undergo heat exchange; thus the design pressure of the high-pressure heat exchanger is determined by the pressure of the high-pressure liquid oxygen. With regard to the low-pressure heat exchanger, if the pressure of the main feed air stream is higher than the pressures of all other fluids entering the low-pressure heat exchanger to undergo heat exchange, then the design pressure of the low-pressure heat exchanger is determined by the pressure of the main feed air stream, and may reach 5-6.5 kg; if the liquid nitrogen product needs to be drawn out from the top of the high-pressure column and pressurized to 10-20 kg in the liquid nitrogen pump, in which case the medium-pressure liquid nitrogen is at a higher pressure than all other fluids entering the low-pressure heat exchanger to undergo heat exchange, then the design pressure of the low-pressure heat exchanger is determined by the pressure of the medium-pressure liquid nitrogen; thus, the design pressure of the low-pressure heat exchanger may reach 6.5-20 kg.

Plate-fin heat exchangers are widely used in cryogenic air separation. Plate-fin heat exchangers are generally made of an aluminum alloy, because aluminum has high thermal conductivity, low density, and mechanical properties which are enhanced in low-temperature conditions. The first heat exchanger and second heat exchanger in the present invention are both preferably plate-fin heat exchangers, but may also be one or more of shell-and-tube heat exchangers, thermal membrane heat exchangers or combined heat exchangers.

Generally, a number of identical heat exchanger units are used and arranged to form the main heat exchanger; each heat exchanger unit is an identical cuboid having substantially identical dimensions. In the present invention, multiple high-pressure heat exchanger units connected in parallel and/or in series form the high-pressure heat exchanger, and multiple low-pressure heat exchanger units connected in parallel and/or in series form the low-pressure heat exchanger; due to the fact that the operating pressures and fluids passing through are different, it can be concluded that the high-pressure heat exchanger units and low-pressure heat exchanger units are of different designs. In principle, each heat exchanger unit in the high-pressure heat exchanger carries out the same function, each heat exchanger unit is passed through by the same number of fluid pipelines, and these are cooled or heated to substantially the same temperature; it is thereby possible to attain a greater heat exchange function. By the same principle, each heat exchanger unit in the low-pressure heat exchanger carries out the same function.

The heat exchanger assembly in the present invention also comprises a subcooler; the subcooler is a heat exchanger that is separate from the main heat exchanger and formed by one or more heat exchanger units, and is generally also a plate-fin heat exchanger. It uses one or more cold-state fluids from the low-pressure column to cool one or more fluids from the high-pressure column, and these cold-state fluids return and, via the main heat exchanger, further cool a hot fluid such as feed air entering the main heat exchanger. In any embodiment of the present invention, the subcooler only has one heat exchanger unit.

The high-pressure heat exchanger and the low-pressure heat exchanger both have a fluid pipeline connection with the subcooler. For example: at least a portion of waste nitrogen gas drawn out from the top of the low-pressure column cools, cools an oxygen-rich liquid from the bottom of the high-pressure column in the subcooler, and then enters the high-pressure heat exchanger to be used for cooling the pressurized feed air stream and the high-pressure feed air stream. The low-pressure nitrogen product and another portion of waste nitrogen gas drawn out from the top of the low-pressure column flow through the subcooler and enter the low-pressure heat exchanger to be used for cooling the main feed air stream. The high-pressure heat exchanger and low-pressure heat exchanger are independent of each other, with no fluid pipeline connection therebetween.

A basic structure of the plate-fin heat exchanger unit is a unit body stacked structure composed of five elements, namely fins, flow-guiding plates, separating plates, side plates and sealing strips. Fins, flow-guiding plates and sealing strips are placed between two adjacent separating plates to form an interlayer, called a channel, and interlayers of this kind are stacked according to different fluid forms, and brazed to form an integral plate bundle; the plate bundle is the core of the plate-fin heat exchanger, and is combined with necessary sealing heads, pipelines and supports, etc. to form the plate-fin heat exchanger unit. The dimension in the direction of channel stacking is defined as the height of the heat exchanger unit; the dimension in the direction of flow of fluid in the channels is defined as the length of the heat exchanger unit.

For the high-pressure heat exchanger and low-pressure heat exchanger formed of a number of heat exchanger units, pipelines comprise a main inlet pipe, distribution pipes, collection pipes and a main outlet pipe. For example, the main feed air stream to be cooled enters multiple distribution pipes via the main inlet pipe, and each distribution pipe sends a portion of the main feed air stream to one of the low-pressure heat exchanger units. Similarly, cooled fluid flows out from each heat exchanger unit through each single collection pipe; each collection pipe is connected to the main outlet pipe, which accommodates cooled fluid sent by the distribution pipes to each heat exchanger unit. The main inlet pipe, distribution pipes, collection pipes and main outlet pipe together form heat exchange fluid pipelines.

The heat exchanger units and heat exchange fluid pipelines directly connected to the heat exchanger units are all preferably made of an aluminum alloy resistant to low temperatures and high pressure, but may also be made of stainless steel, carbon steel or a combination of the above-mentioned materials. The manufacture and connection of the heat exchanger units and heat exchange fluid pipelines are both completed in a special-purpose workshop (e.g. a manufacturing workshop of a supplier). Before exiting the factory, they are supported by a prefabricated steel structure, which is used as a support for transportation from the workshop to the site. If steel plates used as panels for enclosure and protection are installed on an outer surface of the prefabricated steel structure, a heat exchanger cold box is formed.

Depending on equipment dimensions, multiple main heat exchangers may be integrated in one cold box. For example, in relatively small cryogenic air separation equipment, the main heat exchanger and subcooler may be integrated in one cold box. In large air separation equipment, the high-pressure heat exchanger, low-pressure heat exchanger and subcooler are distributed in multiple cold boxes. In the present invention, the first heat exchanger and second heat exchanger are arranged in different cold boxes, called a first heat exchanger cold box and a second heat exchanger cold box respectively, i.e. a high-pressure heat exchanger cold box and a low-pressure heat exchanger cold box. The subcooler is accommodated in a different third cold box. Compared with the arrangement of an integrated heat exchanger cold box, the objective of separate transportation of cold boxes can be achieved. Furthermore, a larger heat exchanger volume can be designed within a permitted transportation dimension range, and it is thereby possible to achieve a greater heat exchange function.

In general, the shape of the heat exchanger cold boxes is a cuboid. After being transported to the site from the workshop, the first heat exchanger cold box, second heat exchanger cold box and subcooler are all installed on the ground, arranged with the length of the heat exchanger units being perpendicular to the ground. A cold box panel surface perpendicular to the ground is called a side, thus each heat exchanger cold box has four sides; a horizontal rectangular face of the covered and formed heat exchanger cold box is defined as a cross section of the cold box. Compared with the low-pressure heat exchanger, the high-pressure heat exchanger is designed to have a smaller cross-sectional area, because a heat exchanger with a higher pressure presents fewer choices regarding heat transfer fin type, and thicker design elements are needed, such as separating plates and side plates, hence the cross-sectional area of the high-pressure heat exchanger is preferably smaller than the cross-sectional area of the low-pressure heat exchanger.

As stated above, besides the heat exchanger units, the heat exchange fluid pipelines are also accommodated in the heat exchanger cold boxes. Heat exchanger fluid entering the main heat exchanger comprises hot fluids and cold fluids; the hot fluids comprise the main feed air stream, the pressurized feed air stream and the high-pressure feed air stream, and the cold fluids comprise the low-pressure nitrogen product and waste nitrogen gas flowing through the subcooler, the medium-pressure liquid nitrogen and the high-pressure liquid oxygen. Generally, the hot fluid enters through a hot end of the main heat exchanger, and flows out through a cold end after being cooled; the cold fluid enters through the cold end of the main heat exchanger, and flows out through the hot end after being heated; the hot end is at an upper end of the heat exchanger unit, and correspondingly, the cold end is at a lower end of the heat exchanger unit.

At the cold end of the high-pressure heat exchanger, at least a portion of waste nitrogen gas drawn out from the top of the low-pressure column and the high-pressure liquid oxygen drawn out from the main condenser-evaporator and pressurized in the liquid oxygen pump, are led into a main inlet pipe for at least a portion of waste nitrogen gas and a main inlet pipe for high-pressure liquid oxygen, used for cooling the pressurized feed air stream and the high-pressure feed air stream. Before entering the high-pressure heat exchanger, these two main inlet pipes must pass through a first opening in a cold box side from outside the high-pressure heat exchanger cold box and enter the high-pressure heat exchanger cold box, then the two main inlet pipes are connected to different units of the high-pressure heat exchanger via multiple distribution pipes respectively, such that the two cold fluids are equally distributed into different units of the high-pressure heat exchanger. At least a portion of waste nitrogen gas flows through the subcooler, then the fluid pipeline passes through a third opening in a subcooler cold box side, and is connected to the main inlet pipe for at least a portion of waste nitrogen gas at the first opening of the high-pressure heat exchanger cold box. A fluid pipeline for high-pressure liquid oxygen passes through the subcooler cold box, but does not flow through the subcooler, then passes out through the third opening in the subcooler cold box side, and is connected to the main inlet pipe for high-pressure liquid oxygen at the first opening of the high-pressure heat exchanger cold box.

At the hot end of the high-pressure heat exchanger, the pressurized feed air stream and high-pressure feed air stream are led into a main inlet pipe for the pressurized feed air stream and a main inlet pipe for the high-pressure feed air stream, and after undergoing reverse heat exchange with at least a portion of waste nitrogen gas and high-pressure liquid oxygen, at the cold end of the high-pressure heat exchanger, the cooled pressurized feed air stream and high-pressure feed air stream are connected from different units of the high-pressure heat exchanger to a main outlet pipe for the cooled pressurized feed air stream and a main outlet pipe for the cooled high-pressure feed air stream via multiple collection pipes respectively; these two main outlet pipes must pass out of the first opening in the cold box side from inside the high-pressure heat exchanger cold box. The main outlet pipe for the cooled pressurized feed air stream must pass out of the first opening in the high-pressure heat exchanger cold box side, then enters the subcooler cold box through the third opening in the subcooler cold box side, but does not flow through the subcooler, then enters a gas expander (about 10% of the cooled pressurized feed air stream is liquid air). The main outlet pipe for the cooled high-pressure feed air stream must also pass out of the first opening in the high-pressure heat exchanger cold box side, then enters the subcooler cold box through the third opening in the subcooler cold box side, but does not flow through the subcooler, then enters a liquid expander.

At the cold end of the low-pressure heat exchanger, the low-pressure nitrogen product and another portion of waste nitrogen gas drawn out from the top of the low-pressure column, which are used for cooling the main feed air stream, are led into a main inlet pipe for the low-pressure nitrogen product and a main inlet pipe for another portion of waste nitrogen gas. Before entering the low-pressure heat exchanger, these two main inlet pipes must pass through a second opening in a cold box side from outside the low-pressure heat exchanger cold box and enter the low-pressure heat exchanger cold box, then the two main inlet pipes are connected to different units of the low-pressure heat exchanger via multiple distribution pipes respectively, such that the two cold fluids are equally distributed into different units of the low-pressure heat exchanger. The medium-pressure liquid nitrogen, which has been drawn out from the top of the high-pressure column and pressurized in the liquid nitrogen pump, is also led into a main inlet pipe for medium-pressure liquid nitrogen at the cold end of the low-pressure heat exchanger. By the same principle, before entering the low-pressure heat exchanger, the main inlet pipe for medium-pressure liquid nitrogen must also pass through the second opening in the cold box side from outside the low-pressure heat exchanger cold box and enter the low-pressure heat exchanger cold box, then the main inlet pipe for medium-pressure liquid nitrogen is connected to different units of the low-pressure heat exchanger via multiple distribution pipes, such that the medium-pressure liquid nitrogen is equally distributed into different units of the low-pressure heat exchanger. The low-pressure nitrogen product and the other portion of waste nitrogen gas flow through the subcooler, then the two fluid pipelines pass through a fourth opening in a subcooler cold box side, and are connected to the main inlet pipe for the low-pressure nitrogen product and the main inlet pipe for another portion of waste nitrogen gas at the second opening of the low-pressure heat exchanger cold box respectively. A fluid pipeline for medium-pressure liquid nitrogen passes through the subcooler cold box, but does not flow through the subcooler, then passes out through the fourth opening in the subcooler cold box side, and is connected to the main inlet pipe for medium-pressure liquid nitrogen at the second opening of the low-pressure heat exchanger cold box.

At the hot end of the low-pressure heat exchanger, the main feed air stream is led into a main inlet pipe for the main feed air stream, and after undergoing reverse heat exchange with the low-pressure nitrogen product and the other portion of waste nitrogen gas as well as the medium-pressure liquid nitrogen, at the cold end of the low-pressure heat exchanger, the cooled main feed air stream is connected from different units of the low-pressure heat exchanger to a main outlet pipe for the cooled main feed air stream via multiple collection pipes; this main outlet pipe must pass out of the second opening in the cold box side from inside the low-pressure heat exchanger cold box, then enters the subcooler cold box through the fourth opening in the subcooler cold box side, but does not flow through the subcooler, then enters the low-pressure column.

All of the main outlet pipes and main inlet pipes of the high-pressure heat exchanger and low-pressure heat exchanger cold end are disposed at lower ends of the high-pressure heat exchanger cold box and the low-pressure heat exchanger cold box; correspondingly, the first opening in the high-pressure heat exchanger cold box side, the second opening in the low-pressure heat exchanger cold box side, and the third and fourth openings in the subcooler cold box side are also located at lower ends of their respective cold boxes; this facilitates the interconnection of heat exchange fluid pipelines at elevation positions close to the ground.

Furthermore, meter air pipelines pass through the third opening and fourth opening in the subcooler cold box side respectively, and are connected to the high-pressure heat exchanger cold box and low-pressure heat exchanger cold box, but do not flow through the high-pressure heat exchanger, the low-pressure heat exchanger or the subcooler.

Thus, a first group of pipelines in the present invention comprises the main inlet pipe for at least a portion of waste nitrogen gas and the main inlet pipe for high-pressure liquid oxygen which are led into the high-pressure heat exchanger cold box, the main outlet pipe for the cooled pressurized feed air stream and the main outlet pipe for the cooled high-pressure feed air stream, and a high-pressure meter air pipeline. The first group of pipelines pass through the first opening of the high-pressure heat exchanger cold box, and preferably have extensions to facilitate connection. A corresponding third group of pipelines pass through the third opening of the subcooler cold box, and preferably have extensions to facilitate connection. The extensions of the first group of pipelines and the third group of pipelines are welded to blind flanges in the workshop, to prevent rainwater and dust from entering the pipelines during transportation.

A second group of pipelines comprises the main inlet pipe for the low-pressure nitrogen product and the main inlet pipe for another portion of waste nitrogen gas which are led into the low-pressure heat exchanger, the main inlet pipe for medium-pressure liquid nitrogen that leads into the low-pressure heat exchanger, and the main outlet pipe for the cooled main feed air stream. The second group of pipelines pass through the second opening of the low-pressure heat exchanger cold box, and preferably have extensions to facilitate connection. A corresponding fourth group of pipelines pass through the fourth opening of the subcooler cold box, and preferably have extensions to facilitate connection. The extensions of the second group of pipelines and the fourth group of pipelines are welded to blind flanges in the workshop, to prevent rainwater and dust from entering the pipelines during transportation.

In respect of the pipelines included in the first group of pipelines, the second group of pipelines, the third group of pipelines and the fourth group of pipelines, the present invention is not limited to the preferred embodiments above. The abovementioned pipelines are not necessary; furthermore, it is also possible to include and have pipelines contained in other equipment for producing other air components.

The first group of pipelines passing through the first opening of the high-pressure heat exchanger cold box side are arranged adjacently as far as possible; this allows the high-pressure heat exchanger cold box to have fewer openings. By the same principle, the second group of pipelines passing through the second opening of the low-pressure heat exchanger cold box side are also arranged adjacently as far as possible.

If the third opening and the fourth opening are on two oppositely disposed sides of the subcooler cold box, then the heat exchanger assembly is defined as being assembled in a linear arrangement; a particular embodiment will be expounded by means of FIG. 1. If the third opening and the fourth opening are on the same side of the subcooler cold box, then the heat exchanger assembly is defined as being assembled in a U-shaped arrangement; a particular embodiment will be expounded by means of FIG. 2. If the third opening and the fourth opening are on two adjacently disposed sides of the subcooler cold box, then the heat exchanger assembly is defined as being assembled in an L-shaped arrangement; a particular embodiment will be expounded by means of FIG. 3. The linear arrangement, U-shaped arrangement and L-shaped arrangement serve as preferred embodiments, indicating that in the present invention, the various cold boxes can be arranged in the most rational manner and with a maximized site utilization rate according to site conditions.

After the high-pressure heat exchanger cold box, the low-pressure heat exchanger cold box and the subcooler cold box have been transported to the site, the blind flanges are removed. Then, the first group of pipelines and the third group of pipelines, and the second group of pipelines and the fourth group of pipelines, are correspondingly connected by means of connection components. The connection components of the high-pressure heat exchanger cold box and the subcooler cold box comprise straight pipes and/or curved pipes required according to the actual arrangement of pipelines, with two ends connected to the first group of pipelines and the third group of pipelines respectively; the connection may be a bolted flange connection, and may also be a welded connection. By the same principle, the connection components of the low-pressure heat exchanger cold box and the subcooler cold box comprise straight pipes and/or curved pipes required according to the actual arrangement of pipelines, with two ends connected to the second group of pipelines and the fourth group of pipelines respectively; the connection may be a bolted flange connection, and may also be a welded connection.

Then, sealing panels are installed at the openings of the high-pressure heat exchanger cold box, the low-pressure heat exchanger cold box and the subcooler cold box, such that the cold box becomes an airtight case, and the interior thereof is packed with a thermally isolating material, which is expanded perlite or rock wool. The extensions of the first group of pipelines outside the high-pressure heat exchanger cold box, the extensions of the third group of pipelines outside the subcooler cold box and the connection components therebetween are then encapsulated together in a first thermally isolating casing. The extensions of the second group of pipelines outside the low-pressure heat exchanger cold box, the extensions of the fourth group of pipelines outside the subcooler cold box and the connection components therebetween are encapsulated together in a second thermally isolating casing.

Preferably, the thermally isolating casing has a frame made from surrounding U-shaped profiles on four sides; these U-shaped profiles have two ends connected by welding to the abovementioned sealing panels, and can then sustain the load of the thermally isolating casing itself as well as forces which occur at the site; these forces may be caused by the wind or earthquakes. Generally, four joining plates of this kind form an airtight cuboid space, and the pipelines and connection components are encapsulated in the casing; the connection between one joining plate thereof and an adjacent joining plate may be accomplished by welding. Since the pipelines and connection components outside the cold boxes mentioned above must be kept cold, a hole is left in one joining plate to allow packing with a thermally isolating material.

FIG. 1 shows an embodiment of assembly of the heat exchanger assembly in the present invention. A first heat exchanger cold box 1 and a second heat exchanger cold box 2 are arranged at two opposite sides of a subcooler cold box 3. This means that a third opening 4 and a fourth opening 5 are on two oppositely disposed sides of the subcooler cold box. A thermally isolating casing 6 is disposed in a sealed manner between the first heat exchanger cold box 1 and the subcooler cold box 3. A thermally isolating casing 7 is disposed in a sealed manner between the second heat exchanger cold box 2 and the subcooler cold box 3. The heat exchanger assembly is assembled in a linear arrangement.

Figure 2:
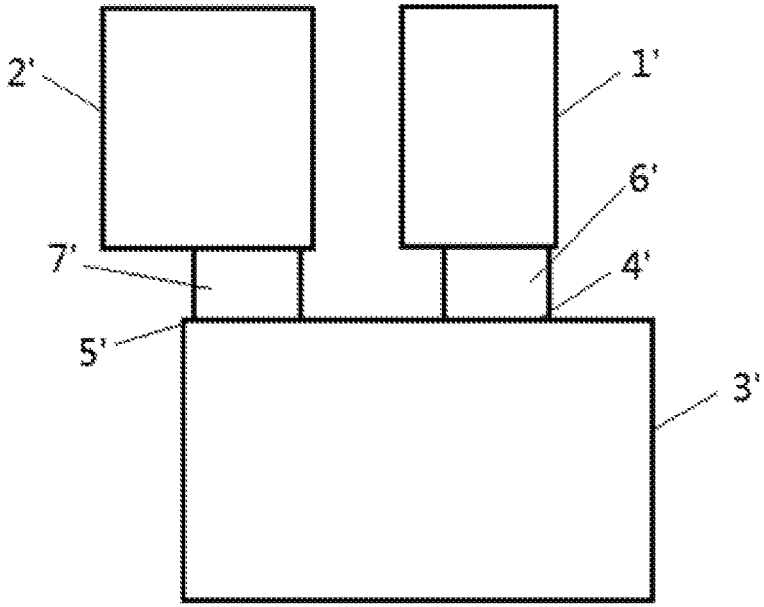
FIG. 2 shows another embodiment of assembly of the heat exchanger assembly in the present invention.

FIG. 2 shows another embodiment of assembly of the heat exchanger assembly in the present invention. A first heat exchanger cold box 1' and a second heat exchanger cold box 2' are arranged at the same side of a subcooler cold box 3'. This means that a third opening 4' and a fourth opening 5' are on the same side of the subcooler cold box. A thermally isolating casing 6' is disposed in a sealed manner between the first heat exchanger cold box 1' and the subcooler cold box 3'. A thermally isolating casing 7' is disposed in a sealed manner between the second heat exchanger cold box 2' and the subcooler cold box 3'. The heat exchanger assembly is assembled in a U-shaped arrangement.

Figure 3:
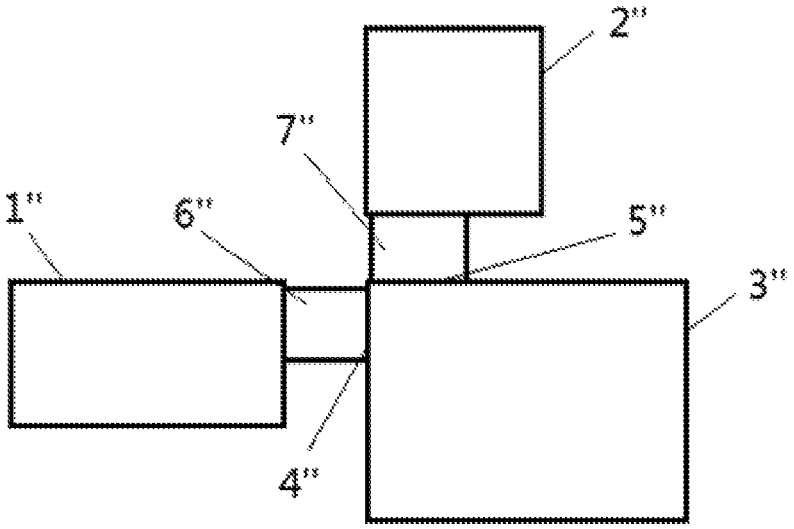
FIG. 3 shows another embodiment of assembly of the heat exchanger assembly in the present invention.

FIG. 3 shows another embodiment of assembly of the heat exchanger assembly in the present invention. A first heat exchanger cold box 1" and a second heat exchanger cold box 2" are arranged at two adjacent sides of a subcooler cold box 3". This means that a third opening 4" and a fourth opening 5" are on two adjacently disposed sides of the subcooler cold box. A thermally isolating casing 6" is disposed in a sealed manner between the first heat exchanger cold box 1" and the subcooler cold box 3". A thermally isolating casing 7" is disposed in a sealed manner between the second heat exchanger cold box 2" and the subcooler cold box 3". The heat exchanger assembly is assembled in an L-shaped arrangement.

FIGS. 1-3 only show the exterior structures of the high-pressure heat exchanger cold box, the low-pressure heat exchanger cold box, the subcooler cold box and the thermally isolating casing. Details of pipelines and the interiors of the cold boxes, etc. are not shown.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

I claim:

1. A heat exchanger assembly comprising:

a first heat exchanger being a higher-pressure heat exchanger and a second heat exchanger being a lower-pressure heat exchanger, the first heat exchanger and the second heat exchanger forming a main heat exchanger in a cryogenic air separation plant;

a subcooler;

a first heat exchanger cold box configured to accommodate the first heat exchanger and heat exchange fluid pipelines, the first heat exchanger cold box having a first opening being disposed in a side of the first heat exchanger cold box, and a first group of the heat exchange fluid pipelines of the first heat exchanger extending through the first opening;

a second heat exchanger cold box configured to accommodate the second heat exchanger and heat exchange fluid pipelines, the second heat exchanger cold box having a second opening being disposed in a side of the second heat exchanger cold box, and a second group of the heat exchange fluid pipelines of the second heat exchanger extending through the second opening; and a subcooler cold box, configured to accommodate the subcooler and heat exchange fluid pipelines, the subcooler cold box having a third opening and a fourth opening being each disposed in a side of the subcooler cold box, and a third group of the heat exchange fluid pipelines of the subcooler and a fourth group of the heat exchange fluid pipelines of the subcooler extending through the third opening and the fourth opening respectively, wherein the first group of heat exchange fluid pipelines and the third group of heat exchange fluid pipelines are connected and encapsulated in a first thermally isolating casing, and the second group of heat exchange fluid pipelines and the fourth group of heat exchange fluid pipelines are connected and encapsulated in a second thermally isolating casing, wherein the first heat exchanger, the second heat exchanger, and the subcooler are all plate fin heat exchangers, wherein the subcooler is a heat exchanger that is separate from the main heat exchanger and formed by one or more heat exchanger units, wherein the subcooler is adapted to use one or more cold-state fluids from a lower-pressure column of the air separation plant to cool one or more fluids from a higher-pressure column of the air separation plant, wherein the subcooler is configured to send these cold-state fluids to the main heat exchanger thereby cooling a hot fluid, and wherein each one of the first and second thermally isolating casings are packed with thermally isolating material.

2. The heat exchanger assembly according to claim 1, wherein the first heat exchanger cold box, the second heat exchanger cold box and the subcooler cold box are all installed on the ground.

3. The heat exchanger assembly according to claim 2, wherein the third opening and the fourth opening are on two oppositely disposed sides of the subcooler cold box.

4. The heat exchanger assembly according to claim 2, wherein the third opening and the fourth opening are on the same side of the subcooler cold box.

5. The heat exchanger assembly according to claim 2, wherein the third opening and the fourth opening are on two adjacently disposed sides of the subcooler cold box.

6. The heat exchanger assembly according to claim 1, wherein the first group of heat exchange fluid pipelines and the third group of heat exchange fluid pipelines, and the second group of heat exchange fluid pipelines and fourth group of heat exchange fluid pipelines, are connected by means of connection components.

7. The heat exchanger assembly according to claim 6, wherein the connection components comprise a pipeline and/or a flange.

8. The heat exchanger assembly according to claim 1, wherein the first group of heat exchange fluid pipelines comprises:

a main inlet pipe for at least a portion of waste nitrogen gas;

a main inlet pipe for high-pressure liquid oxygen;

a main outlet pipe for a cooled pressurized feed air stream; and a main outlet pipe for the cooled high-pressure feed air stream, and a high-pressure meter air pipeline.

9. The heat exchanger assembly according to claim 1, wherein the second group of heat exchange fluid pipelines comprises:

a main inlet pipe for the low-pressure nitrogen product;

a main inlet pipe for another portion of waste nitrogen gas which is led into the lower-pressure heat exchanger;

a main inlet pipe for medium-pressure liquid nitrogen that leads into the low-pressure heat exchanger; and a main outlet pipe for a cooled main feed air stream.

10. A method for the construction of the heat exchanger assembly according to claim 1, the method comprising the following steps:

manufacturing the first heat exchanger cold box, the second heat exchanger cold box and the subcooler cold box in a workshop, and transporting said cold boxes to a site, connecting the first group of heat exchange fluid pipelines and the third group of heat exchange fluid pipelines at the site via first connection components, installing a first sealing panel and a third sealing panel on the first opening and the third opening, respectively, and encapsulating all of the first group of heat exchange fluid pipelines, the third group of heat exchange fluid pipelines, and the first connection components in the first thermally isolating casing;

connecting the second group of heat exchange fluid pipelines and the fourth group of heat exchange fluid pipelines via second connection components, installing a second sealing panel and a fourth sealing panel on the second opening and the fourth opening, respectively, and encapsulating all of the second group of heat exchange fluid pipelines, the fourth group of heat exchange fluid pipelines, and the second connection components in the second thermally isolating casing.

11. The method according to claim 10, wherein the thermally isolating casings are connected to the sealing panels by welding.

12. The method according to claim 10, further comprising connecting the first group of heat exchange fluid pipelines and the third group of heat exchange fluid pipelines without using a crane.

13. The method according to claim 10, wherein the third group of heat exchange fluid pipelines and the first group of heat exchange fluid pipelines are welded together at the site, wherein the fourth group of heat exchange fluid pipelines and the second group of heat exchange fluid pipelines are welded together at the site.

* * * * *